United States Patent [19]

Klaus et al.

[11] Patent Number: 4,479,375

[45] Date of Patent: Oct. 30, 1984

[54] BENDING MANDREL ARRANGEMENT

[75] Inventors: Siegfried Klaus, Ennepetal; Albert Einhaus, Hagen, both of Fed. Rep. of Germany

[73] Assignee: Rolf Peddinghaus, Ennepetal, Fed. Rep. of Germany

[21] Appl. No.: 514,856

[22] Filed: Jul. 18, 1983

Related U.S. Application Data

[63] Continuation of Ser. No. 248,315, Mar. 27, 1981, abandoned.

[30] Foreign Application Priority Data

Apr. 10, 1980 [DE] Fed. Rep. of Germany ..... 3013849

[51] Int. Cl.[3] ..... B21D 7/022

[52] U.S. Cl. ..... 72/387; 72/319; 72/482

[58] Field of Search ..... 72/319–321, 72/316, 387, 388, 482; 140/107

[56] References Cited

U.S. PATENT DOCUMENTS

| | | | |
|---|---|---|---|
| 348,423 | 8/1886 | Shackleton | 72/321 |
| 1,721,698 | 7/1929 | Krueger | 72/319 |
| 2,190,839 | 2/1940 | Jensen | 72/319 |
| 2,302,958 | 11/1942 | Jensen | 72/319 |
| 3,120,257 | 2/1964 | Webers et al. | 72/321 |
| 3,350,912 | 11/1967 | Smith, Jr. | 72/319 |

FOREIGN PATENT DOCUMENTS

| | | | |
|---|---|---|---|
| 1234177 | 9/1967 | Fed. Rep. of Germany . | |
| 1283790 | 11/1968 | Fed. Rep. of Germany | 72/388 |
| 2145809 | 3/1973 | Fed. Rep. of Germany | 72/388 |
| 2816585 | 11/1978 | Fed. Rep. of Germany | 140/107 |
| 373711 | 5/1907 | France | 72/319 |

*Primary Examiner*—Daniel C. Crane
*Attorney, Agent, or Firm*—Holman & Stern

[57] ABSTRACT

A bending mandrel arrangement for use in a machine for the simultaneous bending of a plurality of parallel reinforcing rods for concrete comprises a work support beam on which the rods rest, a trackrail mounted on said work support and having an upper open grooveway and a vertical wall, a plurality of mandrels having arms which engage in said trackway and abut said vertical wall so that the mandrel arms can be simultaneously urged into clamping engagement with said trackrail, and a bending bar which is movable around said mandrel arms to bend said rods.

8 Claims, 5 Drawing Figures

BENDING MANDREL ARRANGEMENT

This is a continuation of application Ser. No. 248,315, filed Mar. 27, 1981 now abandoned.

FIELD OF THE INVENTION

This invention relates to a bending mandrel arrangement in a bending machine designed for the simultaneous bending of concrete-reinforcing steel wires.

DESCRIPTION OF THE PRIOR ART

A bending mandrel arrangement of this kind is known from German Pat. No. 1283790, in which concrete-reinforcing steel wire mesh units, or mats, are advanced on a work support so as to bring their leading ends beneath the bending mandrels whereupon a bending bar, which is mounted on a transverse bending beam, is pivotally displaced and simultaneously bends the end portions of all of the reinforcing wires around the individually associated bending mandrels. In such an arrangement it is an essential requirement that the relative spacing of the bending mandrels must correspond to the relative spacing of the steel wires which are to be bent thereby. Since the spacing may vary in different kinds of mats the mandrels must be adapted to be fixed on the work support beam in correspondingly variable positions. In the above known arrangement this result is obtained by means of a longitudinal open slot in the upper side of the hollow work support beam in which slot there is engaged a runner, or shoe, with bevelled sections which is connected to the mandrel by means of a finger element and further provided with a screw threaded engagement with a clip plate which corresponds in length to the length of the runner but is wider than the slot, so that the position of the mandrel can be fixed by tightening the screw, that is to say pressing the clip plate against the inside wall of the work support beam. When the screw is slackened each bending mandrel can be slid along the longitudinal slot in the work support beam and thus adjusted to the desired spacing pattern. However, for slidingly adjusting the mandrels in this fashion very considerable friction must be surmounted, particularly since in most cases the bending machine will be set up in the open air and exposed to rough service conditions so that easy-running guides are not a practical proposition. This makes the setting up of the mandrels for different kinds of mats a very laborious and time-consuming process. The setting-up of the bending mandrels becomes particularly difficult if, for a given job, several of the mandrels have to be removed altogether, because each of these mandrels must then be frontally slid out of the work support beam, i.e. slid along the slot and disengaged at the frontal end of the beam. Likewise, if additional mandrels are needed these can only be introduced in the same laborious fashion. Moreover, in as much as the individual runners or shoes of the mandrels must be clamped fast on the inaccessible inside of the work support beam, which can be freely entered by rust, scale and dirt dropping off the reinforcing mats on top, the operations of removing, fitting and fixing the mandrels in their correct positions present considerable problems.

BRIEF SUMMARY OF THE INVENTION

It is the object of the present invention to provide a bending mandrel arrangement which involves substantially less effort in the setting up and fixation of the individual mandrels and which, takes the usual rough service conditions of a bending machine of the kind specified fully into account.

Thus, with the new bending mandrel arrangement a peripherally closed bending beam may be used which at once eliminates all the problems liable to arise from the uncontrolled entry of dirt and other impurities into the interior space of the work support beam. Moreover, since the mandrel-fixation means are arranged on the vertical outside wall of the work support beam they are in clear view and easily accessible whilst dirt and other impurities, in so far as these do not already drop off of their own accord from the substantially vertical walls, can also be easily removed. Above all, however, the individual bending mandrels, each being provided with push-lift engageable arm or lever, need no longer be displaced horizontally into the correct operative position for a given job but may be dropped vertically from above straight into the proper place for each mandrel. This is not only much quicker than the lateral adjustment in a guideway slot, but also substantially easier. Furthermore, when the mandrels have been correctly positioned for the envisaged work they can be securely locked in the selected position due to the provision of horizontally effective tightening means and the upper and lower ends as well as the seating faces of their arms are firmly applied to the respectively cooperating surfaces. After release, or slackening off the fixing means, which according to the proposals of this invention may be of different form and configuration, the mandrels can be easily lifted off and re-fitted in another position.

The fixing of the bending mandrels is considerably facilitated by the provision of elastic pillows, conveniently in the form of a continuous rubber buffer strip extending over the length of the work support beam between the lower lever ends and the corresponding sidewall region of the work support beam facing the bending bar.

BRIEF DESCRIPTION OF THE DRAWINGS

The invention is more particularly described with reference to an embodiment shown by way of example in the accompanying drawings wherein.

DETAILED DESCRIPTION

Figure 1:
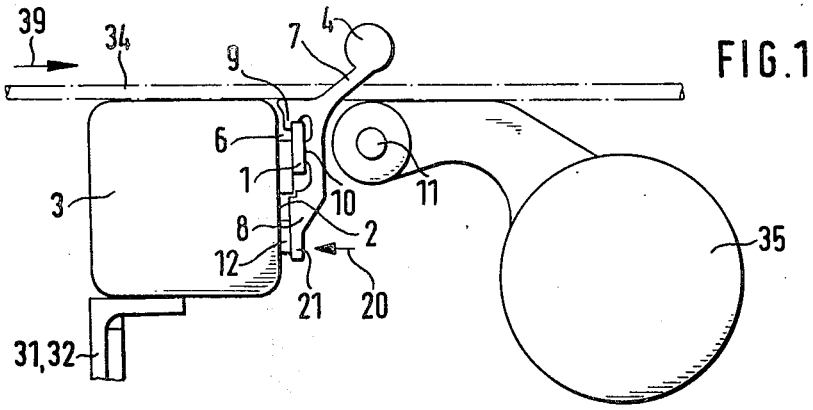
FIG. 1 is a schematic cross-sectional view through that part of a bending machine which is provided with the new bending mandrel arrangement of this invention.
Figure 2:
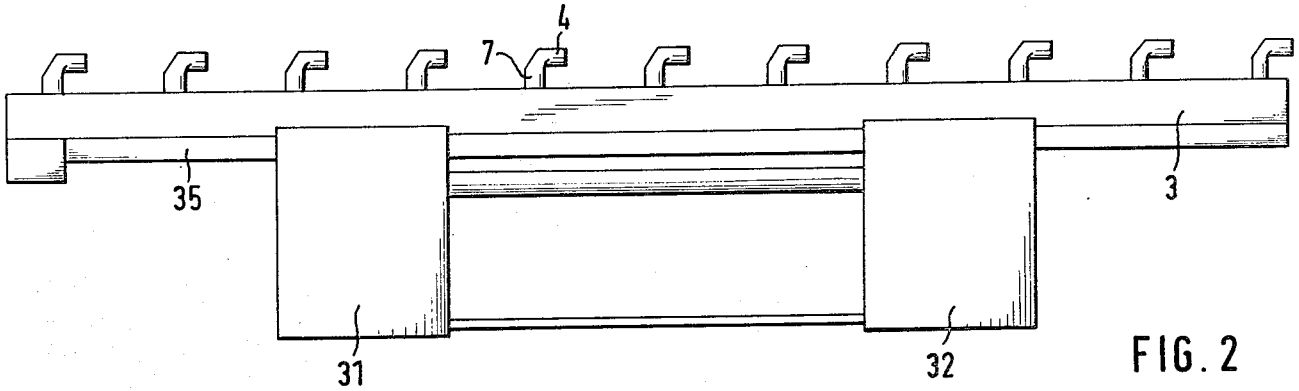
FIG. 2 is a front elevational view of a bending machine which comprises a plurality of bending mandrels.

FIG. 1 shows the upper part of a bending machine comprising a work support beam 3 on which the concrete-reinforcing steel wires 34 are advanced in the direction of arrow 39. These wires arrive beneath the bending mandrels 4 which are angled sideways as shown in FIG. 2, so that the wires 34 can pass directly beneath them, finding lateral support and guidance along the fingers 7.

The work support beam 3 is rigidly mounted on the uprights 31,32 of the machine stand. Also mounted on these uprights in a manner not specifically shown is the transverse bending beam 35 which, on a mounting arm, carries the bending bar 11. This bending bar 11 is adapted to be displaced by means of a drive not here particularly shown, in such a way as to bend the wires 34 around the respectively associated mandrels 4 in the desired manner. Arrangements of this kind are known, for instance from the earlier mentioned German Pat. No. 12 83 790.

According to the present invention, a track rail 1 is arranged on that side 2 of the work support beam 3 which faces the bending bar 11, and is secured to the beam 3 by means of an intervening mounting and spacer bar 50 so as to form an upwardly open grooveway 6. The bending mandrel 4 has a finger 7 whereby it is connected to a push-fittable lever 8. The upper end 9 of this lever is cranked, or angled and engages in grooveway 6. The lever also has a seating face 10 adapted to co-act with the outer wall surface of the track rail 1. The lever 8 further has a bottom end 21 which butts against a rubber buffer strip 12 affixed to the above mentioned side wall 2 of the work support beam 3. Thus the upper lever end 9 sits firmly on the inside of rail 1 and the seating face 10 sits securely on the outer wall surface 5 of the rail 1 whilst the lower lever end 21, by virtue of the provision of a tightening device which is effective in the direction of arrow 20, has a certain amount of play relative to the work support beam so that it can be tightened and clamped fast by application of the tightening device in the direction of arrow 20.

Figure 3:
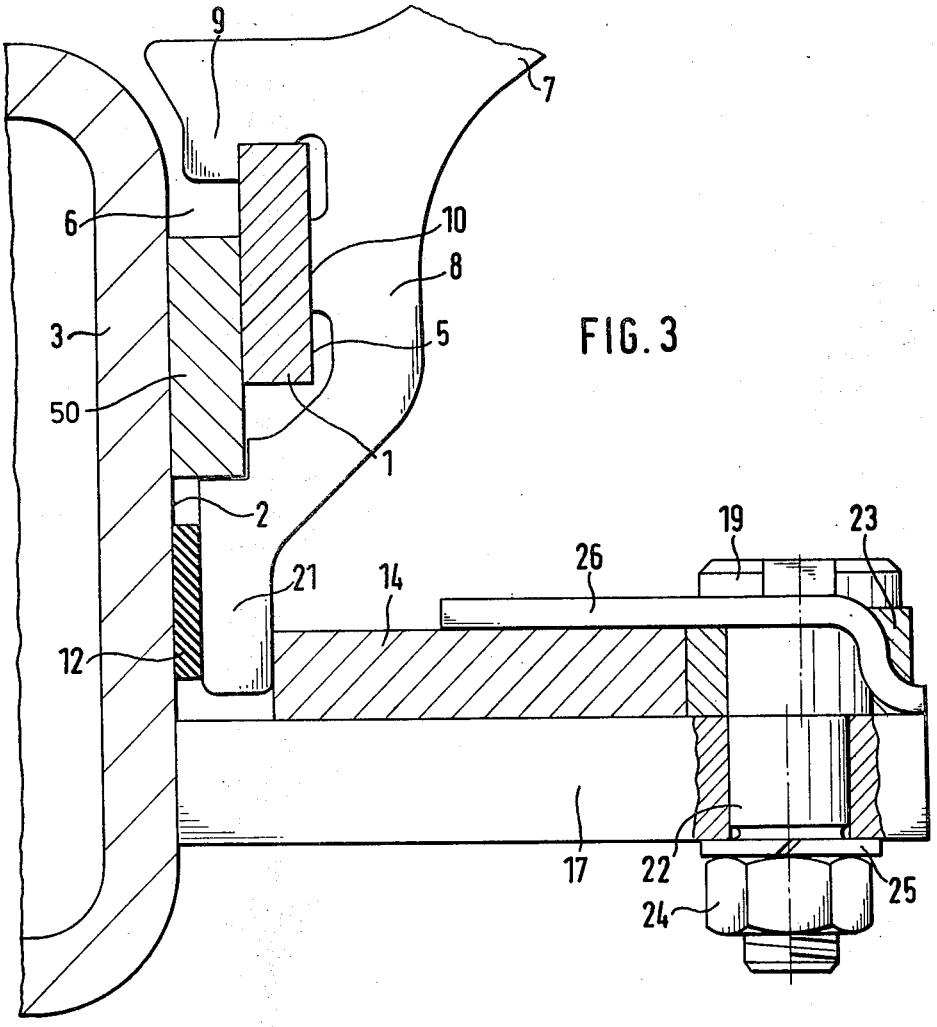
FIG. 3 is an enlarged cross-sectional view showing details of the bending mandrel arrangement according to FIG. 1.

FIG. 3, which is an enlarged detail view, shows, on the one hand, the fixation of lever 8 on the work support beam 3 and, on the other hand, a tightening or clamping device which can be operatively applied to the lower lever end 21. This clamping device is a longitudinal bar 14, cross-sectionally represented in the drawing, which is supported on brackets 17 which extend from the work support beam 3. A guide member 26 prevents all movement of the clamping bar 14 other than in the horizontal direction, and since the bar 14 extends continuously over the length of the beam 3 it can be applied to the bottom ends 21 of all the mandrel levers 8 in the machine. It will further be noted from the drawing that a bolt 22 is eccentrically fitted in the outer end of the bracket arm 17, said bolt 22 being rotatable and adjustable in such a way that it pushes a roller 23 in front of the clamping bar 14. In this way a clamping action can be applied and the eccentric bolt 22 can subsequently be locked in position by means of a nut 24 which is secured by the spring washer 25.

Figure 4:
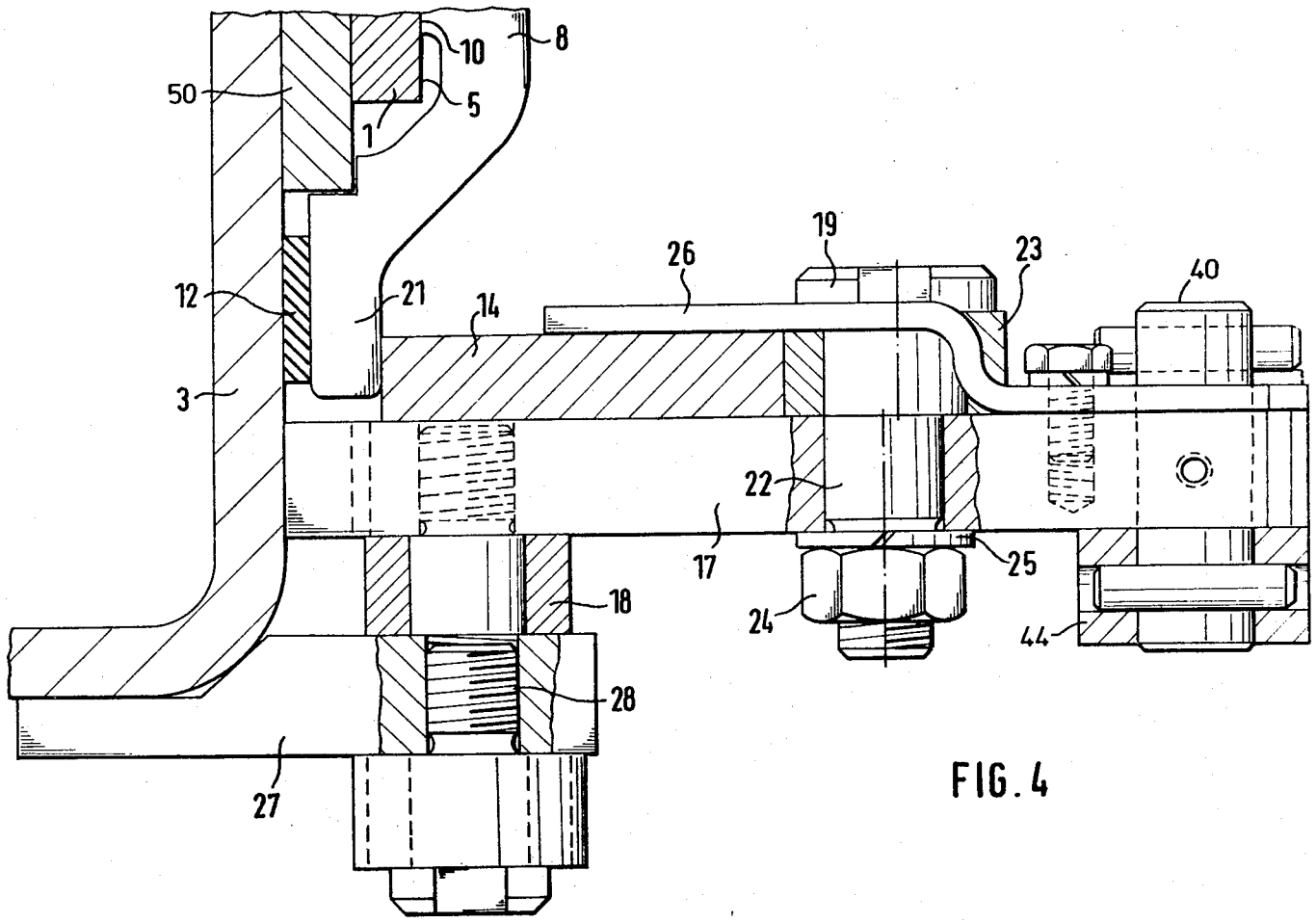
FIG. 4 is a fragmental cross-sectional view corresponding to FIG. 3 but showing a further development of the new bending mandrel arrangement of this invention.
Figure 5:
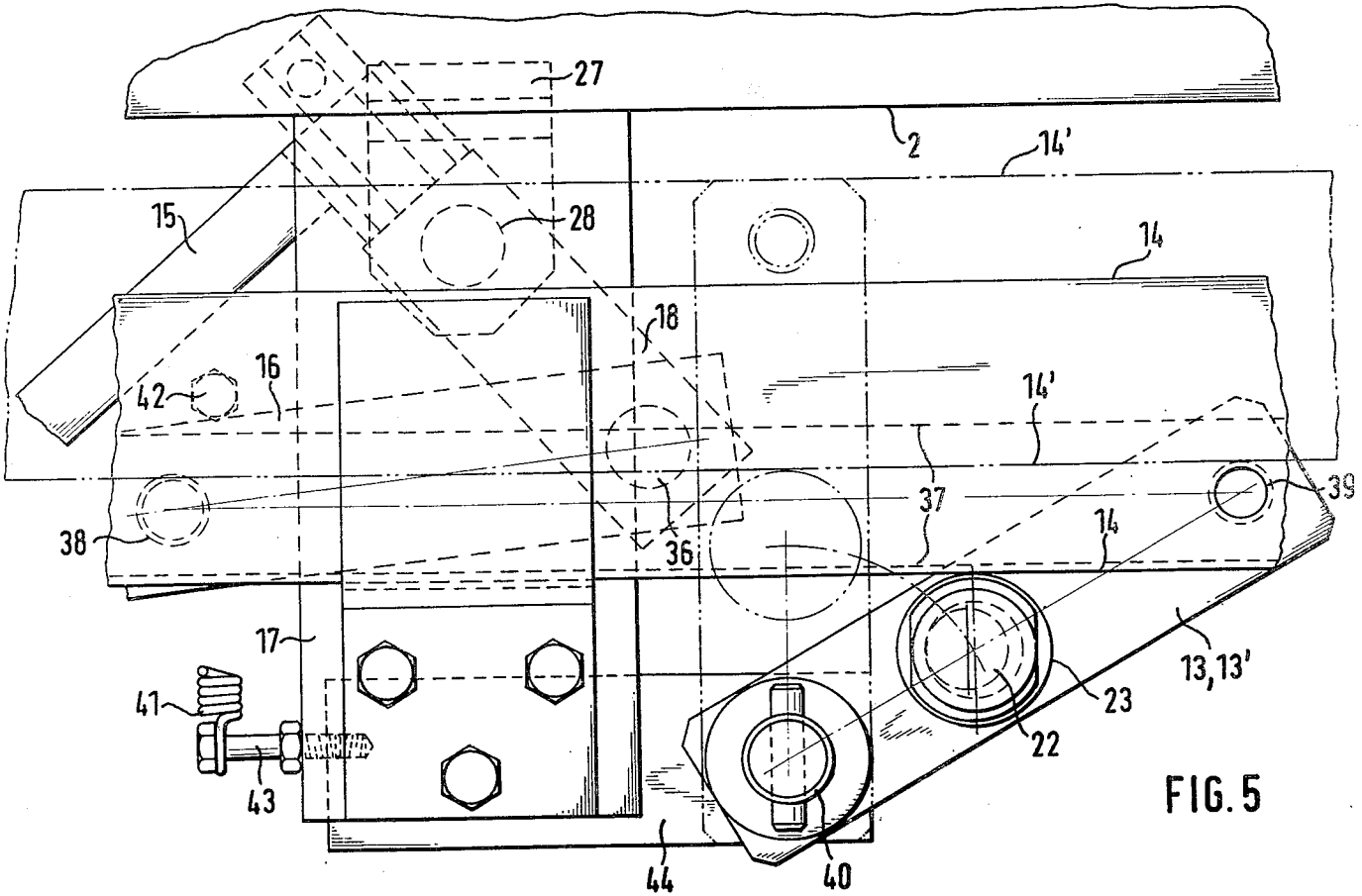
FIG. 5 is a top plan view of the embodiment shown in FIG. 4.

Another embodiment of a locking device for the tightening means, that is to say primarily for the clamping bar 14, is shown in FIGS. 4 and 5. A further, lower bracket arm 27 extends away from the work support beam 3 and comprises a bearing 28 for a toggle lever 18 which latter has a handle part 15 and forms a manual operating handle. As will be seen from FIG. 5, the toggle lever 18 has a joint 36 at its end whereby it is articulated to an intermediate lever 16 which in its turn is articulated at 38 to a pull rod 37. The handle part 15 can be pivoted clockwise from the position shown in FIG. 5 so that the rod 37 is in traction. By means of a plurality of cocking levers 13,13' having in each case one end articulated by joint 39 on the rod 37 whilst their other ends are articulated at 40 to the bracket arms 17, a parallelogram-type guide system is created for the pull rod 37 with respect to the articulations 40 on the bracket arms 17. As soon as the rod is in tension, therefore, the cocking levers 13,13' pivot counterclockwise about 40 to assume the position shown in dotted lines in FIG. 5. The cocking levers further carry the eccentric bolts 22 and with them the rollers 23 which are applied to the outside edge of the clamping bar 14 and precisely adjusted relative to the latter. Consequently, when lever 15 is turned in the clockwise direction the rollers 23 will press the clamping bar 14 in the direction of side wall 2 of the work support beam 3 so that the clamping bar 14 will thus tend to slide in the direction of arrow 20 in FIG. 1. Since it engages with the bottom ends 21 of levers 8 it presses the latter hard against the buffer strip 12 thus locking the bending mandrels fast in the position in which they have been fitted. In this last described situation the clamping bar 14 occupies position 14' as indicated in broken lines. In order to ensure its return to the initial position when the lock is released springs 41 are provided which engage in the vicinity of the bracket arms 17 with bolts 42 screwed into the underside of clamping bar 14 and are connected at the other end to bolts 43 on the arms 17. These springs thus urge, or pull the clamping bar 14 outwards when load relieved. Conveniently the arrangement will be such that for tightening the device by means of the manual operating lever 15,18 the cocking levers 13,13' are pivoted into a position from which they cannot swing back without external force application. This will be the case, for instance if they occupy the position shown in FIG. 5, normal to the work support beam. In order to enable the unobstructed execution of this or a similar kind of movement of the tensioning or cocking levers these levers are not directly hinged on the arms 17 but connected to the latter by means of linkplates 44. Apart from this, as already mentioned, in each case a plurality, that is to say more than one and at least two such levers will be provided although only one is shown in FIG. 5 where, for clearer representation, the pull rod 37 is shown only in its initial position. Its operative clamping position results from the parallel displacement due to the parallelogram-guide system.

We claim:

1. A bending mandrel arrangement for simultaneous bending of a plurality of steel wires, comprising a work support having a surface on which said wires are supported, a plurality of bending mandrels, around which said wires may be bent, mounted on said work support, a bending bar mounted adjacent said work support for guided movement around said mandrels, a track rail extending along a surface of said work support other than said surface on which the work is supported adjacent said bending bar, said track rail having a wall which is engageable by said mandrels and which is substantially perpendicular to said surface on which the work is supported, said track rail being spaced from said work support to define a grooveway which opens towards said work support surface between said track rail and said work support, each said bending mandrel comprising a crank arm having a first end engageable in said grooveway, a second end having a clearance with respect to a fixed part of the arrangement in a direction normal to said wall, and being provided intermediate said ends with a seating face which engages said wall, and clamping means movable normally with respect to said wall to urge said second ends of said crank arms towards said work support to reduce said clearance and to effect clamping engagement between said arms and said track rail.

2. An arrangement as claimed in claim 1 and further comprising a resilient element engageable by said second ends of said mandrel arms when the latter are urged into said clamping engagement.

3. An arrangement as claimed in claim 2 wherein said trackrail and said resilient element are mounted on said work support.

4. An arrangement as claimed in claim 3 wherein said resilient element comprises a continuous strip extending lengthwise of said work support.

5. An arrangement as claimed in claim 1 and further comprising bracket members extending from said work support towards said clamping means comprises a bending bar, and said clamping bar movably mounted on said bracket members.

6. An arrangement as claimed in claim 5 and further comprising means for biasing said clamping bar away from said work support, and wherein said means for moving said clamping bar comprises actuating means for urging said clamping bar into engagement with said mandrel arms.

7. A bending mandrel arrangement for simultaneous bending of a plurality of steel wires, comprising a work support having a surface on which said wires are supported, a plurality of bending mandrels, around which said wires may be bent, mounted on said work support, a bending bar mounted adjacent said work support for guided movement around said mandrels, a track rail extending along a surface of said work support other than said surface on which the work is supported adjacent said bending bar, said track rail having a wall which is engageable by said mandrels and which is substantially perpendicular to said surface on which the work is supported, said track rail defining a grooveway opening between said track rail and said work support, each said bending mandrel comprising a crank arm having a first end engageable in said grooveway, a second end having a clearance with respect to a fixed part of the arrangement, and being provided intermediate said ends with a seating face which engages said wall, and clamping means engaging said second end of each of said crank arms to urge said second ends toward said work support to pivot said arm about said seating face and thereby clamp said arm to said track rail.

8. A bending mandrel arrangement for simultaneous bending of a plurality of steel wires, comprising a work support having a surface on which said wires are supported, a plurality of bending mandrels, around which said wires may be bent, mounted on said work support, a bending bar mounted adjacent said work support for guided movement around said mandrels, a track rail extending along a surface of said work support other than said surface on which the work is supported adjacent said bending bar, said track rail having a wall which is engageable by said mandrels and which is substantially perpendicular to said surface on which the work is supported, said track rail defining a grooveway opening between said track rail and said work support, each said bending mandrel comprising a crank arm having a first end engageable in said grooveway, a second end having a clearance with respect to a fixed part of the arrangement, and being provided intermediate said ends with a seating face which engages said wall, a plurality of bracket members extending from said work support towards said bending bar, a clamping bar mounted on said bracket members and extending substantially parallel to said track rail, means biasing said clamping bar away from said track rail, and actuating means for moving said clamping bar normally of said wall into engagement with said second ends of the mandrel arms, to urge said mandrel arms into clamping engagement with said track rail, said actuating means comprising a pull rod supported on said bracket members by parallel levers each of which pivotally engages a bracket member and said pull rod to provide a parallelogram linkage, said parallel levers being provided with means for engaging said clamping bar, and manually operable means for moving said pull rod.

* * * * *